US005593291A

United States Patent [19]

Lynn

[11] Patent Number: 5,593,291

[45] Date of Patent: Jan. 14, 1997

[54] FLUID PUMPING APPARATUS

[75] Inventor: William H. Lynn, Kohler, Wis.

[73] Assignee: Thomas Industries Inc., Sheboygan, Wis.

[21] Appl. No.: 506,491

[22] Filed: Jul. 25, 1995

[51] Int. Cl.[6] ..... F04B 1/18

[52] U.S. Cl. ..... 417/539; 417/269

[58] Field of Search ..... 417/269, 271, 417/419, 539; 91/500, 501

[56] References Cited

U.S. PATENT DOCUMENTS

| | | | |
|---|---|---|---|
| 862,867 | 8/1907 | Eggleston | 417/472 X |
| 3,961,868 | 6/1976 | Droege, Sr. et al. | 417/550 |
| 4,028,015 | 6/1977 | Hetzel | 417/415 |
| 4,138,203 | 2/1979 | Slack | 417/269 |
| 4,396,357 | 8/1983 | Hartley | 417/269 |
| 4,507,058 | 3/1985 | Schoenmeyr | 417/271 X |
| 4,610,605 | 9/1986 | Hartley | 417/269 |
| 4,776,257 | 10/1988 | Hansen | 92/12.2 |
| 4,801,249 | 1/1989 | Kakizawa | 417/269 |
| 5,070,765 | 12/1991 | Parsons | 92/71 |
| 5,147,190 | 9/1992 | Hovarten | 417/269 X |
| 5,362,208 | 11/1994 | Inagaki et al. | 417/269 |

FOREIGN PATENT DOCUMENTS

| | | | |
|---|---|---|---|
| 4411383 | 11/1994 | Germany | 417/269 |

*Primary Examiner*—Richard E. Gluck
*Attorney, Agent, or Firm*—Quarles & Brady

[57] ABSTRACT

A fluid pumping apparatus is disclosed in which wobble pistons are rigidly connected to arms of a swashplate that is rotatably mounted on bearings which are mounted on a drive shaft. The axis of the bearings is at an acute angle to the axis of the shaft. The wobble pistons move within cylinders whose bores are parallel to the axis of the shaft. Two or more pistons and cylinders are arranged symmetrically about the shaft axis, and cylinder-piston combinations are mounted at opposite ends of a through shaft.

14 Claims, 4 Drawing Sheets

FIG. 1
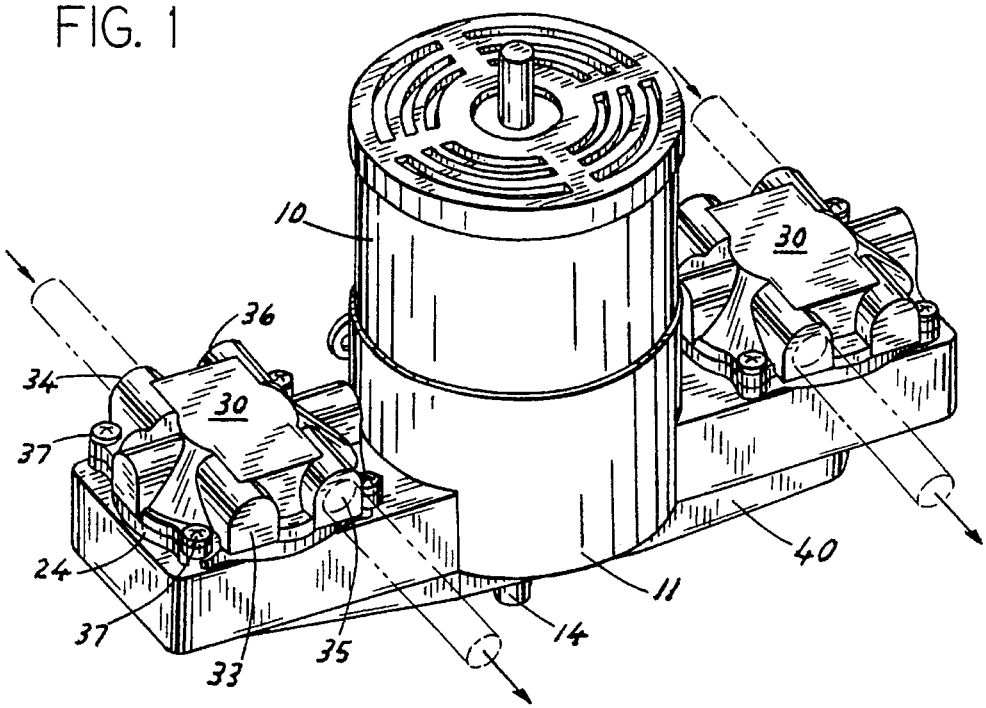
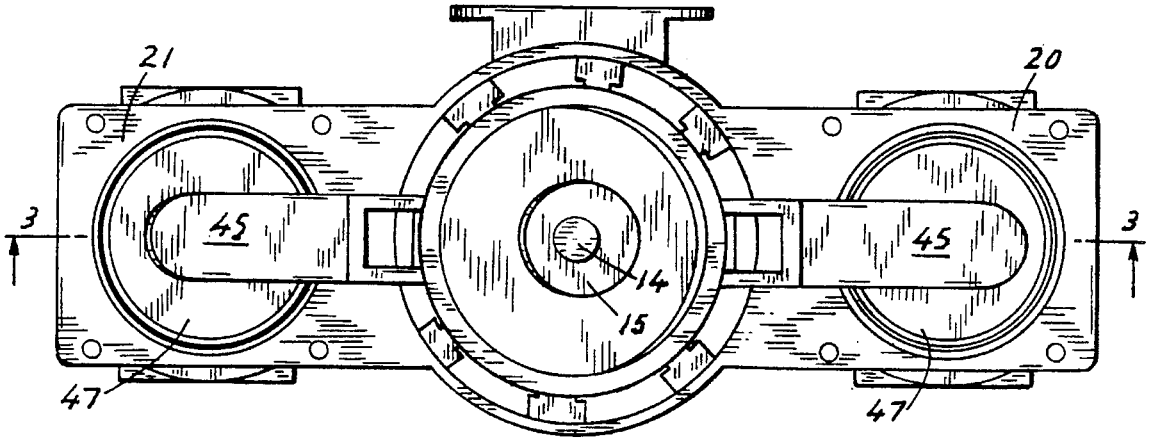
FIG. 2
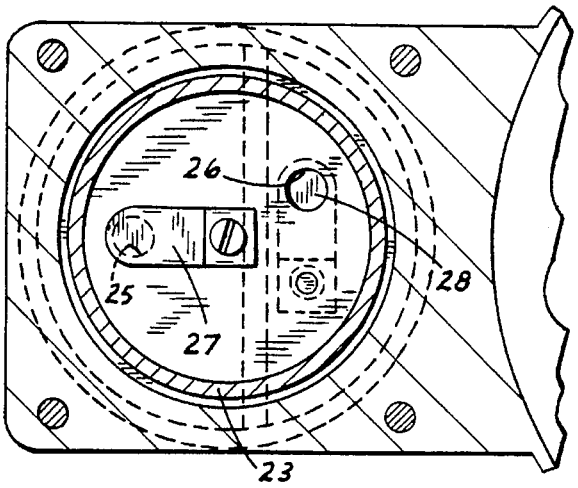
FIG. 5

FIG. 4
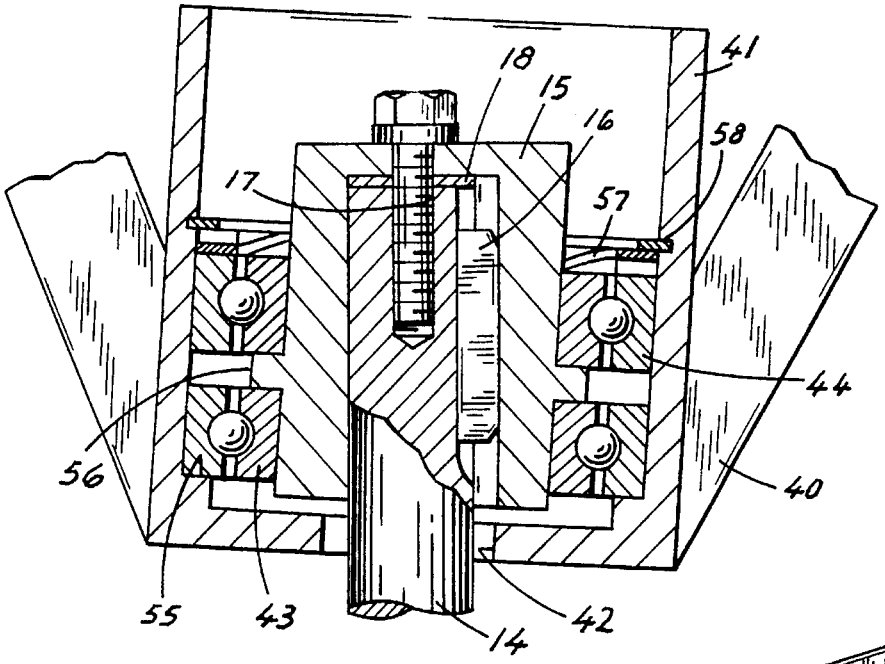
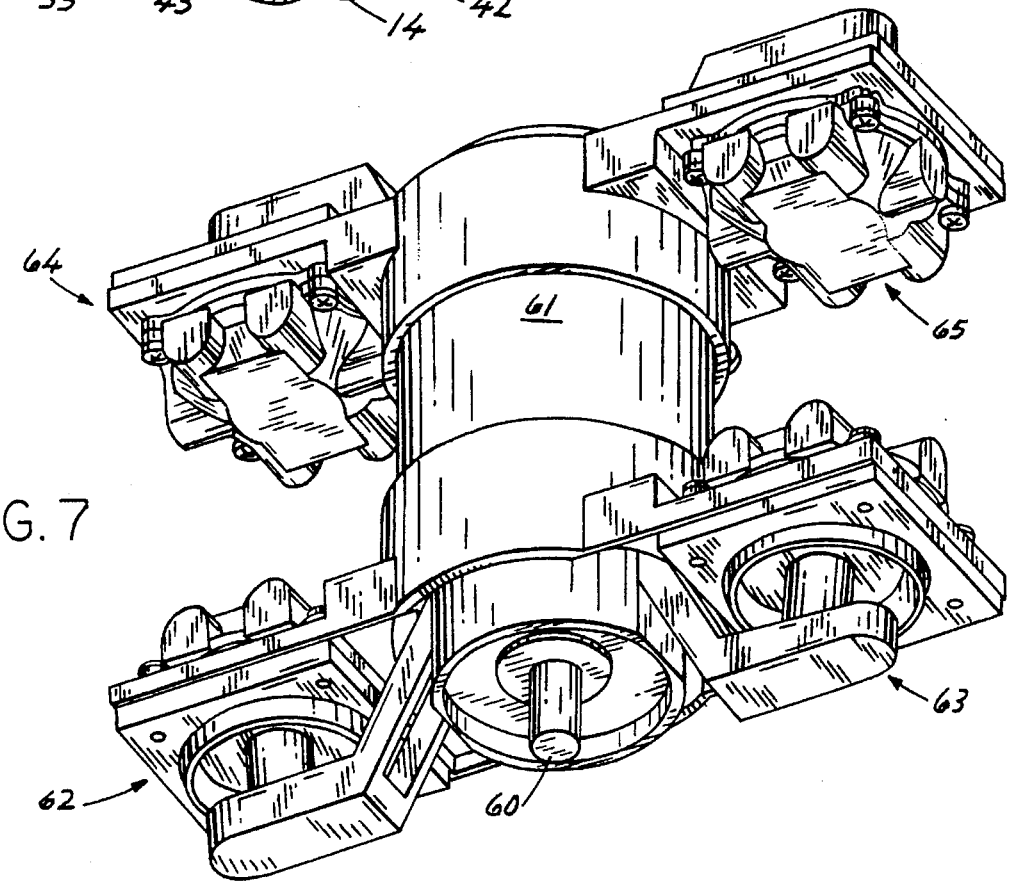
FIG. 7

FLUID PUMPING APPARATUS

BACKGROUND OF THE INVENTION

This invention relates to an axial piston fluid pumping apparatus, and more particularly to such an apparatus which uses a wobble piston, the stroke for which is provided by a swashplate.

Two known types of compressors are the wobble piston type and the swashplate type. The wobble piston type is exemplified by U.S. Pat. No. 3,961,868 issued Jun. 8, 1976, to Droege, Sr., et al. for "Air Compressor". Such a compressor uses a piston whose head has a peripheral seal that seals with a cylinder bore. The piston rod is mounted radially on a crankshaft. The piston includes no joints or swivels. As a result, the piston head is forced to "wobble" in two dimensions within the cylinder bore as it is driven by the crankshaft.

The swashplate type compressor uses a plurality of axial cylinders arranged in a circle about a drive shaft. A swashplate is inclined relative to the shaft axis such that the plate gyrates as the drive shaft is rotated. Pistons are mounted in each of the cylinders. The ends of the piston rods are connected to elements that slide over the surface of the swashplate as the swashplate rotates. The result is that the centerline of the piston head is moved solely in an axial direction as the pistons are stroked within the cylinders. An example of such an axial piston swashplate compressor is found in U.S. Pat. 5,362,208 issued Nov. 8, 1994 to Inagaki, et al. for "Swashplate Type Compressor". Another example is U.S. Pat. No. 4,776,257 issued Oct. 11, 1988, to Hansen for "Axial Pump Engine". In the Hansen Patent, the centerline of the piston heads are inclined relative to the centerline of the cylinder bore, but the piston heads are moved only along the piston head centerline in one direction.

The present invention combines the wobble pistons normally used in radial piston pumps with the swashplate normally used in axial piston pumps. The result is a simple and effective fluid pumping apparatus.

SUMMARY OF THE INVENTION

In accordance with the invention, a fluid pumping apparatus includes a drive shaft and a cylinder having a bore that is parallel to the axis of the shaft. Fluid inlet and outlet valves communicate with the cylinder bore. A bearing is mounted on the shaft with the centerline of the bearing at an angle to the shaft axis. An arm is rotatably mounted on the bearing. A wobble piston is rigidly attached to the arm and is disposed in the cylinder bore. As the drive shaft rotates, the centerline of the bearing will precess about the shaft axis, and the arm will be moved, thereby causing the wobble piston to move in three dimensions within the cylinder bore.

Further in accordance with the invention, the bearing is mounted on a hub that is secured to the shaft with the axis of the hub at an acute angle to the shaft axis.

Preferably, two or more cylinders are arranged symmetrically about the shaft axis with a wobble piston in each cylinder bore.

In yet another preferred embodiment, the drive shaft is a through-shaft of an electric motor. Two or more cylinders are spaced about each end of the through-shaft. A swashplate containing two or more arms is rotatably mounted about a bearing on each end of the through-shaft. Wobble pistons are rigidly attached to each arm and disposed in a respective cylinder. Preferably, the cylinder bores on one end of the through-shaft are axially aligned with the cylinder bores on the other end, and the pistons in aligned cylinder bores move opposite to each other.

It is a principle object of the invention to provide a simplified axial piston pumping apparatus using wobble pistons.

It is another object of the invention to provide an axial piston pump which does not require the use of sliding elements requiring continuous lubrication.

The foregoing and other objects and advantages of the invention will be apparent from the following detailed description. In the description, reference is made to the drawings which illustrate preferred embodiments of the invention.

BRIEF DESCRIPTION OF THE DRAWINGS

FIG. 1 is a view in perspective of a first embodiment of the invention utilizing a pair of cylinders and wobble pistons;

FIG. 2 is an end view of the apparatus of FIG. 1;

FIG. 4 is an enlarged view in section showing the preferred hub and bearings assembly;

FIG. 5 is a plan view of a valve plate taken in the plane of the line 5—5 of FIG. 3;

FIG. 7 is a view in perspective of a second embodiment of the invention utilizing two pairs of cylinders and wobble pistons.

DETAILED DESCRIPTION OF THE PREFERRED EMBODIMENT

Figure 3:
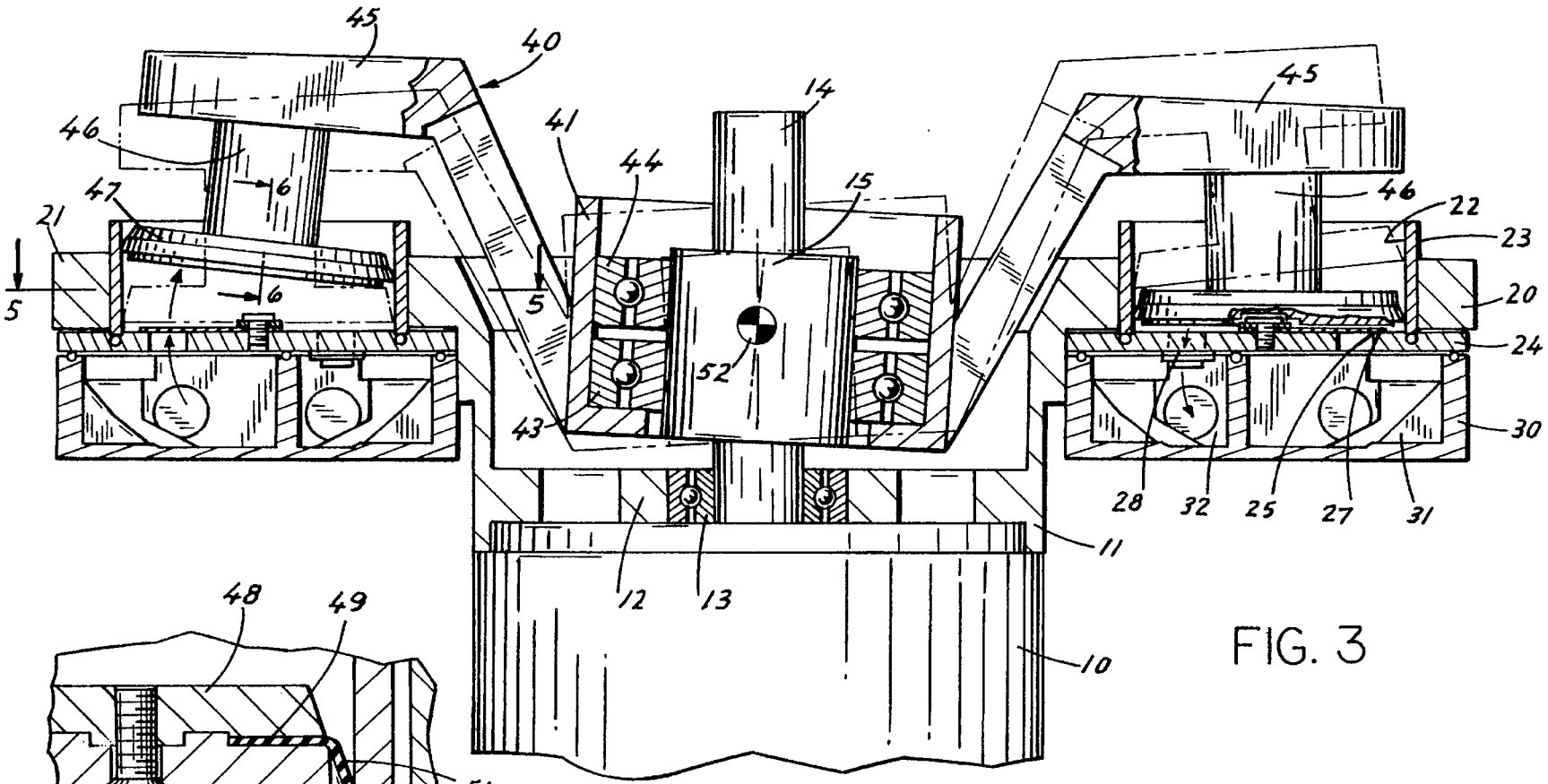
FIG. 3 is a view in section taken in the plane of the line 3—3 of FIG. 2.
Figure 6:
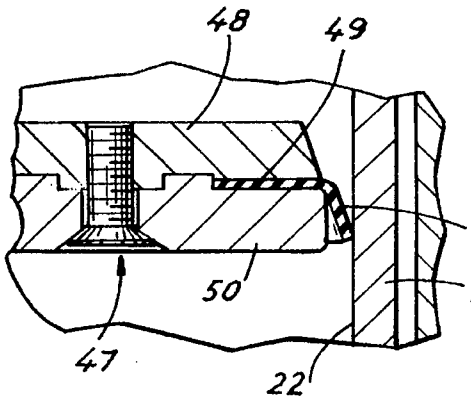
FIG. 6 is an enlarged view in section through a piston head and taken in the plane of the line 6—6 of FIG. 3.

Although the invention can be adapted for pumping a wide variety of fluids, it is particularly useful in an air compressor or vacuum pump. Referring to FIGS. 1 through 6, an electric motor 10 is rabbited to a housing 11. The housing includes a support plate 12 which mounts a bearing 13 for a motor drive shaft 14. A hub 15 is connected to the shaft 14 by means of a key 16, as shown in FIG. 4. The hub 15 is locked axially on the drive shaft 14 by means of a bolt 17 that is threaded into an axial bore in the end of the drive shaft 14. A shim washer 18 is disposed between the head of the bolt 17 and the hub 15 to allow for adjustment of the axial clearance between the shaft 14 and hub 15. As is apparent from FIGS. 3 and 4, the centerline or axis of the hub 15 is at an acute angle to the axis of the shaft 14.

The housing 11 mounts a pair of axial cylinders 20 and 21 having cylinder bores 22 each defined by a cylinder sleeve 23. The axes of the cylinder bores 22 are parallel to the axis of the drive shaft 14. A valve plate 24 closes off the top of each cylinder 20 and 21. Each valve plate 24 includes an inlet valve opening 25 and an outlet valve opening 26. The valve openings 25 and 26 are normally closed by an inlet flapper 27 and an exhaust flapper valve 28, respectively. A cylinder head 30 is mounted on each valve plate 24. The cylinder heads 30 each include an inlet chamber 31 and an exhaust chamber 32. The heads 30 have inlet or outlet connection points 33 and 34 leading to the inlet chamber 31 and similar connection points 35 and 36 leading to the exhaust chamber 32. As will be explained further hereafter, the inlet and exhaust chambers 31 and 32 can be connected in a variety of ways through the connection points 33 through 36 to external piping.

The heads 30 and valve plates 24 are joined to the cylinders 20 and 21 by bolts 37. Suitable O-rings seal the mating surfaces of the head 30 with the valve plate 24 and of the cylinder sleeve 22 with the valve plate 24. The construction of the valve plates 24, heads 30, and cylinder sleeves 22 is similar to that which is illustrated and described in U.S. Pat. No. 4,995,795 issued Feb. 26, 1991, to Hetzel, et al., and assigned to the assignee of this application. The disclosure of the Hetzel, et al. '795 patent is hereby incorporated by reference as though fully set forth herein.

A swashplate 40 has a central cup 41 with an enlarged rear opening 42 that receives the drive shaft 14. A pair of deep-grooved ball bearings 43 and 44 have their inner races mounted about the hub 15 and their outer races mounted within the cup portion 41 of the swashplate 40. The swashplate 40 has a pair of arms 45 extending laterally in opposite directions from the cup portion 41. Each of the arms 45 rigidly mounts a wobble piston 46 having its piston head 47 disposed in the bore of one of the cylinders 20 and 21. The piston heads 47 are of known construction. Briefly, they include a main piston portion 48 which mounts a seal 49 that is clamped to the main portion 48 by a clamp plate 50. The seal 49 has a peripheral flange 51 which seals with the cylinder bore 22. The seal 49 is preferably made of Teflon or other similar material that does not require lubrication. The details of the construction of the piston head are shown in U.S. Pat. No. 5,006,047 issued Apr. 9, 1991, to O'Connell and assigned to the assignee of this invention. The disclosure of the O'Connell '047 patent is hereby incorporated by reference as though fully set forth herein.

As the drive shaft 14 is rotated by the motor 10, the centerline or axis of the hub 15 will precess in a conical path about the axis of the shaft 14. The movement of the hub 15 is translated into three dimensional movement of the piston heads 47 within the cylinder bores 22. The ends of the arms 45 will move through one arc in the plane of the section of FIG. 3. The ends of the arms will also move through a much smaller arc in a plane that is normal to the plane of the section of FIG. 3.

For best operation, the center of gravity 52 of the assembly of the swashplate 40 and the wobble pistons 46 is located at the intersection of the axes of the hub 15 and the drive shaft 14. This will ensure the smoothest, quietest operation with the least vibration.

The preferred assembly of the hub 15, bearings 43 and 44, and cup 41 is shown in FIG. 4. The outer race of one of the bearings 43 is disposed against a ledge 55 in the cup 41. The inner races of the bearings 43 and 44 are disposed against a flange 56 extending from the hub 15. Finally, the outer race of the second bearing 44 abuts a wavy washer 57 held in place by a snap ring 58.

The fluid pumping apparatus does not involve sliding surfaces that must be lubricated, as is typical in axial piston swashplate type compressors. The only sliding action is that of the seal 49 of the wobble pistons on the cylinder bores 22. The seals 49 have proven to be capable of such motion without the need for lubrication.

The apparatus can be used either as a compressor or a pump depending upon what devices are connected to the inlet and exhaust chambers. The apparatus of FIGS. 1–6 is arranged to operate as a compressor. To function as a pump, it is preferable to mount the seals 49 in a manner such that their peripheral flanges 51 extend away from the bottom of the cylinder. This is the reverse of that shown in FIGS. 1–6.

Although the first embodiment uses a pair of symmetrically arranged cylinders, any number of cylinders with corresponding numbers of wobble pistons may also be used. The cylinders should be arranged symmetrically about the shaft axis. Furthermore, the invention is also useful with only a single cylinder with a single arm mounting a wobble piston disposed in the single cylinder.

In the embodiment of FIG. 7, a pair of cylinders with wobble pistons are mounted on each end of a through-shaft 60 of a motor 61. In the arrangement of FIG. 7, the assembly of hubs, bearings, cylinders, valve plates, heads, and swashplates, as described with respect to FIGS. 1 through 6, is duplicated on each end of the through-shaft 60 of the motor 61. The cylinder assemblies 62 and 63 on one end of the through-shaft 60 are aligned with the cylinder assemblies 64 and 65 on the other end of the through-shaft 60. To best balance the dynamic forces, the pistons operating in each pair of aligned cylinders 62, 64, and 63, 65 move in opposite directions to each other.

The fluid pumping apparatus of this invention may be used as a compressor or a vacuum pump. It may be plumbed in a variety of manners. For example, the embodiment of FIGS. 1–6 may have each of the cylinders separately plumbed so that each acts as an independent pumping device, either as a compressor or a vacuum pump. As an alternative, the exhaust chamber 32 of one of the two cylinders may be connected to the inlet chamber 31 of the other of the two cylinders so that a two-stage pressure or vacuum operation is achieved.

Figure 8A:
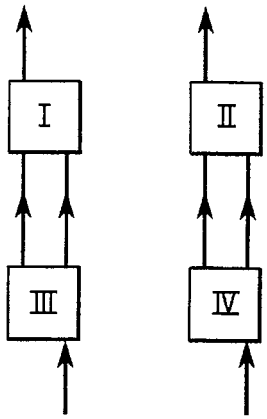
FIGS. 8*a* through 8*d* are schematic representations of alternative arrangements for connecting the cylinders in the embodiment of FIG. 7.
Figure 8B:
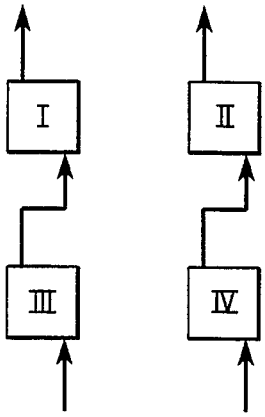

The four-cylinder arrangement of the embodiment of FIG. 7 affords even greater alternatives for interconnection. Some of the possible alternatives are illustrated in FIGS. 8*a* through 8*d* in which the four cylinders are identified by I through IV. In FIG. 8*a*, a compressor or pump arrangement is shown in which the inlet chambers of cylinders III and I are connected in parallel, and the outlet chambers of cylinders III and I are similarly connected in parallel. The result is that cylinders I and III function as two separate compressors or two separate pumps. The cylinders IV and II may be similarly plumbed in parallel so that they can function as two separate compressors or two separate pumps. In the arrangement of FIG. 8*a*, the cylinders I and III can function as compressors while the cylinders II and IV can function as pumps, or vice versa. In the arrangement illustrated in FIG. 8*b*, the pair of cylinders I and III are connected in series. That is, the exhaust chamber of cylinder III is connected to the inlet chamber of cylinder I. The result is that there is a two-stage compression or pumping. In FIG. 8*b*, the cylinders II and IV are similarly connected in series, but they could also be connected in parallel as in FIG. 8*a*.

Figure 8C:
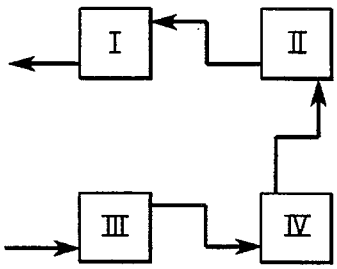
Figure 8D:
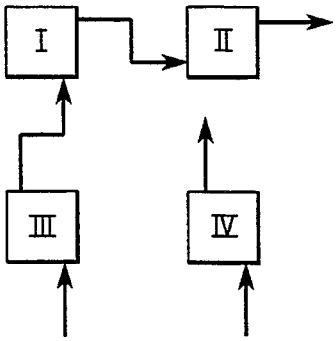

FIG. 8*c* illustrates an arrangement in which all four of the cylinders I through IV are connected in series so that there is a four-stage pumping or compression action. In FIG. 8*d*, three of the cylinder heads I, II, and III are connected in series while the fourth operates separately. Persons of ordinary skill in the art will appreciate many additional arrangements of plumbing that could be used.

Although the preferred embodiments are shown with pairs of arms with rigidly attached pistons, any number of arms and pistons can be employed about the bearings that are mounted on the drive shaft.

I claim:

1. A fluid pumping apparatus, comprising:

a drive shaft;

a cylinder having a bore parallel to the axis of the shaft;

a fluid inlet and a fluid outlet communicating with the cylinder bore;

a bearing mounted on the shaft with the center line of the bearing at an angle to the shaft axis;

an arm mounted on the bearing; and wobble piston disposed in the bore and rigidly attached to the arm.

2. A fluid pumping apparatus in accordance with claim 1 wherein the bearing is mounted on a hub that is mounted on the shaft with the axis of the hub at an acute angle to the shaft axis so that the hub axis precesses about the shaft axis as the shaft is rotated.

3. A fluid pumping apparatus, comprising:

a drive shaft;

a plurality of cylinders having bores disposed symmetrically about and parallel to the axis of the shaft;

fluid inlet and outlet valves communicating with each cylinder bore;

a plurality of symmetrically spaced arms rotatably mounted on a bearing that is mounted on a hub connected to the shaft with the axis of the hub at an acute angle to the shaft axis so that the hub axis precesses about the shaft axis as the shaft is rotated;

a wobble piston rigidly attached to each arm and disposed in and sealed with a respective cylinder bore; and wherein the center of gravity of the arms, pistons, and bearing is at the intersection of the axis of the hub with the shaft axis.

4. A fluid pumping apparatus, comprising:

a drive shaft;

a cylinder having a bore spaced from and parallel to the shaft;

fluid inlet and outlet valves connected to the cylinder;

a piston having a head with a peripheral seal disposed in and sealing with the cylinder bore;

a hub disposed on the shaft with its axis at an angle to the axis of the shaft so that the hub axis precesses about the axis of the shaft; and an arm mounted on the hub and extending laterally to the shaft axis, said arm rigidly mounting the piston, whereby the piston head will be moved in three dimensions in the cylinder bore as the shaft is rotated.

5. A fluid pumping apparatus, comprising:

a driven shaft;

a plurality of cylinders having bores disposed symmetrically about and parallel to the axis of the shaft;

fluid inlets and outlets communicating with each cylinder bore;

a bearing mounted on the shaft with the center line of the bearing at an angle to the shaft axis;

a plurality of arms mounted on the bearing; and a wobble piston rigidly attached to each arm and disposed in a respective cylinder bore.

6. A fluid pumping apparatus comprising:

a drive shaft;

a plurality of cylinders having bores disposed symmetrically about and parallel to the axis of the shaft;

fluid inlet and outlet valves connected to each cylinder bore;

a plate having a plurality of symmetrical spaced arms rotatably mounted about the shaft with the axis of rotation being at an acute angle with respect to the shaft axis;

a piston rigidly attached to each arm and including a piston head with a peripheral seal disposed in and sealed with a respective cylinder bore; and wherein the center of gravity of the plate, arms, and pistons is at about the intersection of the axis of rotation and the shaft axis.

7. A fluid pumping apparatus, comprising:

a housing;

a through drive shaft disposed in the housing;

a pair of cylinders having bores formed in the housing adjacent each end of the shaft, the bores being parallel with the axis of the shaft;

fluid inlet and outlet valves communicating with each cylinder bore;

a hub mounted on each end of the drive shaft with its axis at an acute angle to the shaft axis;

a plate mounted on each hub; and a pair of pistons rigidly attached to each plate and having a piston head disposed in and sealed with a respective cylinder bore.

8. An apparatus in accordance with claim 7 wherein the cylinder bores of one pair of cylinders are aligned with the cylinder bores of the other pair of cylinders.

9. Art apparatus in accordance with claim 8 wherein the pistons in aligned cylinder bores move opposite to each other.

10. An apparatus in accordance with claim 7 wherein an electric motor is disposed in the housing and includes the drive shaft.

11. A fluid pumping apparatus, comprising:

a housing;

an electric motor in the housing and having a through drive shaft;

a plurality of cylinders having bores formed in the housing adjacent each end of the shaft, the bores being parallel with the axis of the shaft and spaced symmetrically about the shaft;

inlet and outlet valves communicating with each cylinder bore;

a hub mounted on each end of the drive shaft with its axis at an acute angle to the shaft axis;

a swashplate mounted on each hub; and a plurality of pistons rigidly attached to each swashplate and each having a piston head disposed in and sealed with a respective cylinder bore.

12. A fluid pumping apparatus in accordance with claim 7 wherein the inlet and outlet chambers of at least two of the cylinders are connected in parallel with each other.

13. A fluid pumping apparatus in accordance with claim 7 wherein the inlet and outlet chambers of at least two of the cylinders are connected in series with each other.

14. A fluid pumping apparatus in accordance with claim 7 wherein the inlet and outlet chambers of all of the cylinders are connected in series with each other.

* * * * *